US011255543B2

(12) United States Patent
Amble et al.

(10) Patent No.: US 11,255,543 B2
(45) Date of Patent: Feb. 22, 2022

(54) DILUTION STRUCTURE FOR GAS TURBINE ENGINE COMBUSTOR

(71) Applicant: General Electric Company, Schenectady, NY (US)

(72) Inventors: Mayank Krisna Amble, Bangalore (IN); Gurunath Gandikota, Bangalore (IN); Perumallu Vukanti, Bangalore (IN); Ravi Chandra, Bangalore (IN); Karthikeyan Sampath, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 363 days.

(21) Appl. No.: 16/057,249

(22) Filed: Aug. 7, 2018

(65) Prior Publication Data

US 2020/0049349 A1 Feb. 13, 2020

(51) Int. Cl.

| | |
|---|---|
| ***F23R 3/06*** | (2006.01) |
| ***F23R 3/00*** | (2006.01) |
| ***F23R 3/28*** | (2006.01) |
| ***F23R 3/04*** | (2006.01) |
| ***F23R 3/50*** | (2006.01) |

(52) U.S. Cl.

CPC ..... *F23R 3/06* (2013.01); *F23R 3/007* (2013.01); *F23R 3/045* (2013.01); *F23R 3/286* (2013.01); *F23R 3/50* (2013.01)

(58) Field of Classification Search

CPC .... F23R 3/06; F23R 3/045; F23R 3/04; F23R 3/002; F23R 3/283; F23R 3/286; F23R 3/50; F23R 3/34; F23R 3/346; F05D 2240/35

See application file for complete search history.

(56) References Cited

U.S. PATENT DOCUMENTS

| | | | | |
|---|---|---|---|---|
| 3,872,664 | A * | 3/1975 | Lohmann | F23R 3/346 60/746 |
| 3,899,882 | A * | 8/1975 | Parker | F23R 3/045 60/752 |
| 4,132,066 | A | 1/1979 | Austin, Jr. et al. | |
| 4,267,698 | A * | 5/1981 | Hartmann | F23R 3/06 60/756 |
| 4,622,821 | A | 11/1986 | Madden | |
| 4,653,279 | A | 3/1987 | Reynolds | |
| 4,700,544 | A | 10/1987 | Fucci | |
| 4,875,339 | A * | 10/1989 | Rasmussen | F23R 3/06 60/757 |
| 4,887,432 | A * | 12/1989 | Mumford | F23R 3/06 60/759 |

(Continued)

FOREIGN PATENT DOCUMENTS

| | | | |
|---|---|---|---|
| CN | 101852132 | A | 10/2010 |
| CN | 103629661 | A | 3/2014 |

(Continued)

*Primary Examiner* — Alain Chau

(74) *Attorney, Agent, or Firm* — Venable LLP; Edward A. Kmett; Michele V. Frank

(57) ABSTRACT

The present disclosure is directed to a combustor assembly for a gas turbine engine. The combustor assembly includes a liner defining a combustion chamber therewithin and a pressure plenum surrounding the liner. The liner defines an opening and includes a walled chute disposed at least partially through the opening. A plurality of flow openings is defined through the walled chute.

17 Claims, 4 Drawing Sheets

(56) References Cited

U.S. PATENT DOCUMENTS 5,235,805 A * 8/1993 Barbier ..... F23R 3/045 60/39.23
5,261,223 A 11/1993 Foltz
5,279,127 A 1/1994 Napoli
5,297,385 A 3/1994 Dubell et al.
5,481,867 A 1/1996 Dubell et al.
5,934,067 A 8/1999 Ansart et al.
6,070,412 A 6/2000 Ansart et al.
6,101,814 A 8/2000 Hoke et al.
6,145,319 A 11/2000 Bums et al.
6,205,789 B1 3/2001 Patterson et al.
6,279,323 B1 8/2001 Monty et al.
6,408,629 B1 6/2002 Harris et al.
6,513,331 B1 2/2003 Brown et al.
7,000,397 B2 2/2006 Pidcock et al.
7,059,133 B2 6/2006 Gerendas
7,124,588 B2 10/2006 Gerendas et al.
7,395,669 B2 * 7/2008 Sherwood ..... F23R 3/04 60/752
7,748,222 B2 7/2010 Bernier et al.
8,281,600 B2 * 10/2012 Chen ..... F23R 3/06 60/772
8,511,089 B2 8/2013 Bastnagel et al.
8,800,146 B2 8/2014 Mao et al.
8,821,600 B2 9/2014 Darby et al.
8,850,828 B2 10/2014 Mongillo, Jr. et al.
9,062,884 B2 6/2015 Rudrapatna et al.
9,151,500 B2 * 10/2015 Chen ..... F23R 3/286
9,273,560 B2 3/2016 Gleiner et al.
9,328,665 B2 * 5/2016 Doerr ..... F23R 3/007
9,388,987 B2 * 7/2016 Valeev ..... F23R 3/346
9,557,060 B2 1/2017 Papple et al.
9,765,969 B2 9/2017 Graves et al.
9,851,105 B2 12/2017 Propheter-Hinckley et al.
9,976,743 B2 * 5/2018 Propheter-Hinckley ..... F23R 3/002
10,024,537 B2 * 7/2018 Taylor ..... F23R 3/002
10,174,947 B1 * 1/2019 Clemen ..... F23R 3/005
10,502,422 B2 * 12/2019 Cunha ..... F02C 7/18
10,520,192 B2 * 12/2019 Shim ..... F23R 3/045
2002/0108374 A1 8/2002 Young et al.
2002/0116929 A1 8/2002 Snyder
2002/0189260 A1 * 12/2002 David ..... F23R 3/045 60/746
2003/0046934 A1 * 3/2003 Sherwood ..... F23R 3/04 60/722
2003/0177769 A1 9/2003 Graves et al.
2003/0182943 A1 10/2003 Gerendas et al.
2003/0213250 A1 11/2003 Pacheco-Tougas et al.
2005/0081526 A1 4/2005 Howell et al.
2006/0130486 A1 6/2006 Danis et al.
2007/0084219 A1 4/2007 Bernier et al.
2007/0193248 A1 8/2007 Bessagnet et al.
2007/0227149 A1 10/2007 Biebel et al.
2008/0010992 A1 1/2008 Patterson et al.
2008/0127651 A1 6/2008 Zupanc et al.
2008/0156943 A1 7/2008 Sreekanth et al.
2009/0003998 A1 1/2009 Woodcock et al.
2009/0100839 A1 4/2009 Cazalens et al.
2009/0100840 A1 4/2009 Campion et al.
2009/0120095 A1 5/2009 Berry et al.
2009/0139239 A1 6/2009 Zupanc et al.
2010/0077763 A1 4/2010 Alkabie
2010/0095679 A1 4/2010 Rudrapatna et al.
2010/0095680 A1 4/2010 Rudrapatna et al.
2010/0122537 A1 5/2010 Yankowich et al.
2010/0218503 A1 9/2010 Bronson et al.
2010/0218504 A1 9/2010 Bronson et al.
2010/0242483 A1 9/2010 Snyder et al.
2010/0251723 A1 * 10/2010 Chen ..... F23R 3/045 60/760
2010/0287941 A1 11/2010 Kim et al.
2011/0023495 A1 2/2011 Bronson et al.
2011/0048024 A1 3/2011 Snyder et al.
2011/0185736 A1 8/2011 McKinney
2011/0219774 A1 9/2011 Bronson et al.
2011/0271678 A1 11/2011 Bourgois et al.
2012/0017596 A1 1/2012 Rudrapatna et al.
2012/0036859 A1 2/2012 Johnson et al.
2012/0137697 A1 6/2012 Sandelis
2012/0186222 A1 7/2012 Commaret et al.
2012/0240584 A1 9/2012 Berdou et al.
2012/0291442 A1 11/2012 Commaret et al.
2012/0297778 A1 11/2012 Rudrapatna et al.
2012/0304647 A1 12/2012 Dudebout et al.
2013/0239575 A1 * 9/2013 Chen ..... F23R 3/04 60/747
2013/0298564 A1 * 11/2013 Agarwal ..... F01D 9/023 60/772
2013/0333387 A1 12/2013 Leblond et al.
2014/0033723 A1 * 2/2014 Doerr ..... F23R 3/007 60/737
2014/0260257 A1 9/2014 Rutland et al.
2014/0338359 A1 * 11/2014 Valeev ..... F23L 7/00 60/776
2015/0323182 A1 * 11/2015 Sandoval ..... F23R 3/02 60/752
2015/0362190 A1 * 12/2015 Taylor ..... F23R 3/002 60/752
2016/0003478 A1 * 1/2016 Propheter-Hinckley ..... F23R 3/002 60/737
2016/0131363 A1 * 5/2016 Cunha ..... F23R 3/50 60/755
2016/0186998 A1 * 6/2016 Kostka, Jr ..... F02C 7/18 60/782
2016/0201908 A1 * 7/2016 Drake ..... F23R 3/06 60/782
2016/0208704 A1 * 7/2016 Bouldin ..... F23R 3/06
2016/0209035 A1 * 7/2016 Cramer ..... F23R 3/06
2016/0290643 A1 * 10/2016 Cunha ..... F02C 7/24
2016/0377289 A1 * 12/2016 Kostka, Jr ..... F23R 3/06 60/752
2017/0089580 A1 * 3/2017 Hu ..... F23R 3/06
2017/0363289 A1 * 12/2017 Shim ..... F23R 3/06
2019/0226680 A1 * 7/2019 North ..... F23R 3/286

FOREIGN PATENT DOCUMENTS

CN 105745419 A 7/2016
FR 2948987 A1 2/2011
FR 2958012 A1 9/2011
GB 2017827 A * 10/1979 ..... F23R 3/045
JP 2015072077 A 4/2015

* cited by examiner

DILUTION STRUCTURE FOR GAS TURBINE ENGINE COMBUSTOR

FIELD

The present subject matter relates generally to gas turbine engine combustion assemblies for gas turbine engines.

BACKGROUND

Combustion assemblies for gas turbine engines generally include orifices in the combustion liners to dilute the combustion gases within the combustion chamber with air from the diffuser cavity. The air may be employed to mix with an over rich combustion gas mixture to complete the combustion process; to stabilize combustion flames within the recirculation zone of the combustion chamber; to minimize oxides of nitrogen emissions; or to decrease combustion gas temperature before egressing to the turbine section.

Although dilution orifices provide known benefits, there is a need for structures that may provide and improve upon these benefits via egressing the air into the combustion chamber in increasingly detailed or specific modes.

BRIEF DESCRIPTION

Aspects and advantages of the invention will be set forth in part in the following description, or may be obvious from the description, or may be learned through practice of the invention.

The present disclosure is directed to a gas turbine engine including a combustor assembly. The combustor assembly includes a liner defining a combustion chamber therewithin and a pressure plenum surrounding the liner. The liner defines an opening. The liner includes a walled chute disposed at least partially through the opening. A plurality of flow openings is defined through the walled chute.

In one embodiment, the walled chute is extended into the pressure plenum surrounding the liner.

In another embodiment, the walled chute defines a flow passage therethrough from the pressure plenum to the combustion chamber.

In yet another embodiment, the plurality of flow openings through the walled chute is in fluid communication with the pressure plenum.

In various embodiments, the walled chute further includes a flow guide member extended from each of the plurality of flow openings through the walled chute. In one embodiment, the flow guide member is extended into the pressure plenum defined by the liner. In still various embodiments, the flow guide member is extended at an angle relative to walled chute. In one embodiment, the flow guide member is extended between 35 degrees and 90 degrees relative to the walled chute.

In one embodiment, the walled chute defines an upstream portion and a downstream portion each relative to a flow of gases in the combustion chamber defined by the liner. The plurality of flow openings is defined through the downstream portion of the walled chute.

In various embodiments, the liner defines a liner flow opening through the liner in fluid communication with the combustion chamber. In one embodiment, the liner flow opening is defined through the liner within a distance from the walled chute equal to a length of the walled chute.

In still various embodiments, the combustor assembly further includes a support member extended through the opening from the liner to the walled chute. The support member fixes the walled chute within the opening of the liner. In one embodiment, the support member and walled chute together define a first flow passage through the walled chute and a second flow passage between the walled chute and the liner.

In one embodiment, the plurality of flow openings is defined through the walled chute tangentially to an inner surface of the walled chute.

In another embodiment, the plurality of flow openings is defined through the walled chute at least partially along a radial direction relative to the walled chute.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
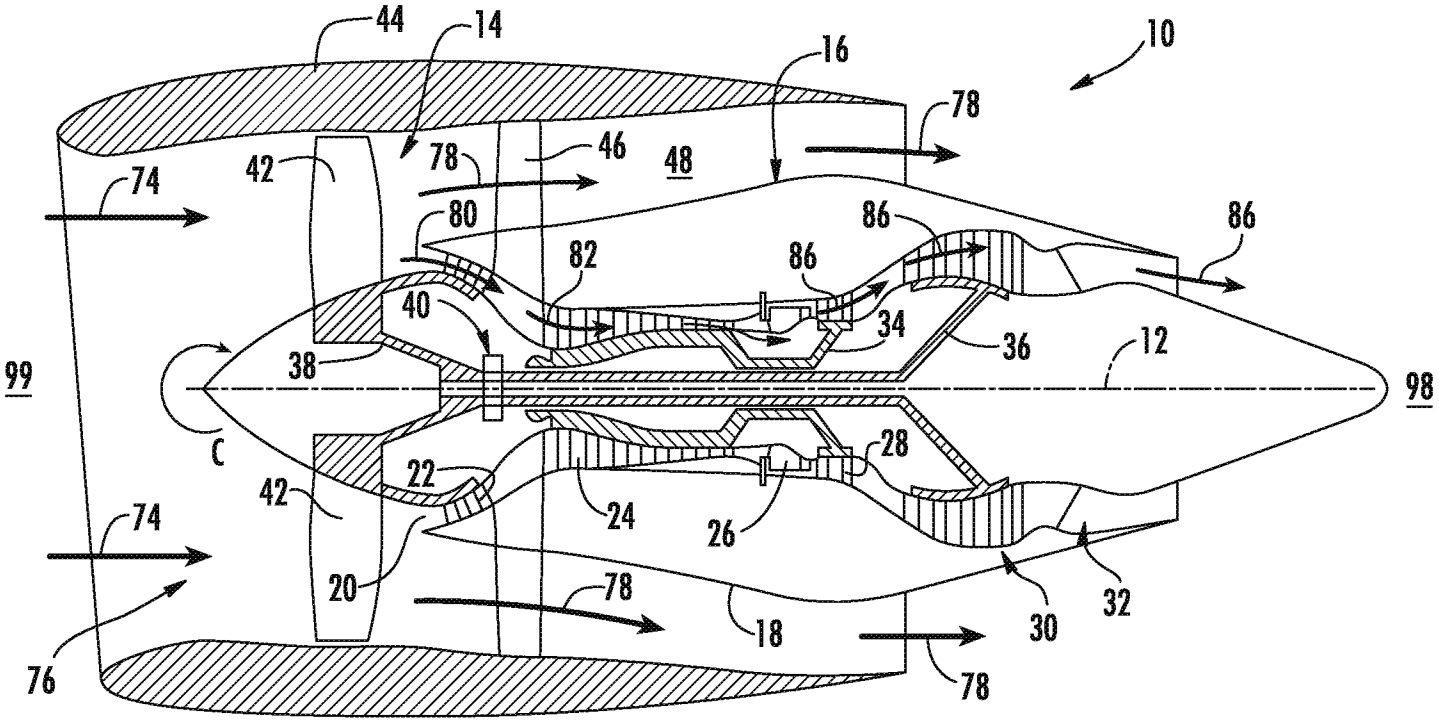
FIG. 1 is a schematic cross sectional view of an exemplary gas turbine engine incorporating an exemplary embodiment of a combustor assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of combustor assembly dilution structures are generally provided that may improve emissions and combustion gas quenching via egressing the air into the combustion chamber in increasingly detailed or specific modes. The various embodiments of combustor assemblies generally define a walled chute configured to egress air from the diffuser cavity to the combustion chamber in multiple or tailored modes.

Referring now to the drawings, FIG. 1 is a schematic partially cross-sectioned side view of an exemplary high bypass turbofan engine 10 herein referred to as "engine 10" as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, the engine 10 has a longitudinal or axial engine centerline axis 12 that extends there through for reference purposes. The engine 10 defines a longitudinal direction L and an upstream end 99 and a downstream end 98 along the longitudinal direction L. The upstream end 99 generally corresponds to an end of the engine 10 along the longitudinal direction L from which air enters the engine 10 and the downstream end 98 generally corresponds to an end at which air exits the engine 10, generally opposite of the upstream end 99 along the longitudinal direction L. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure compressor and turbine rotatable with an intermediate pressure shaft altogether defining a three-spool gas turbine engine.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
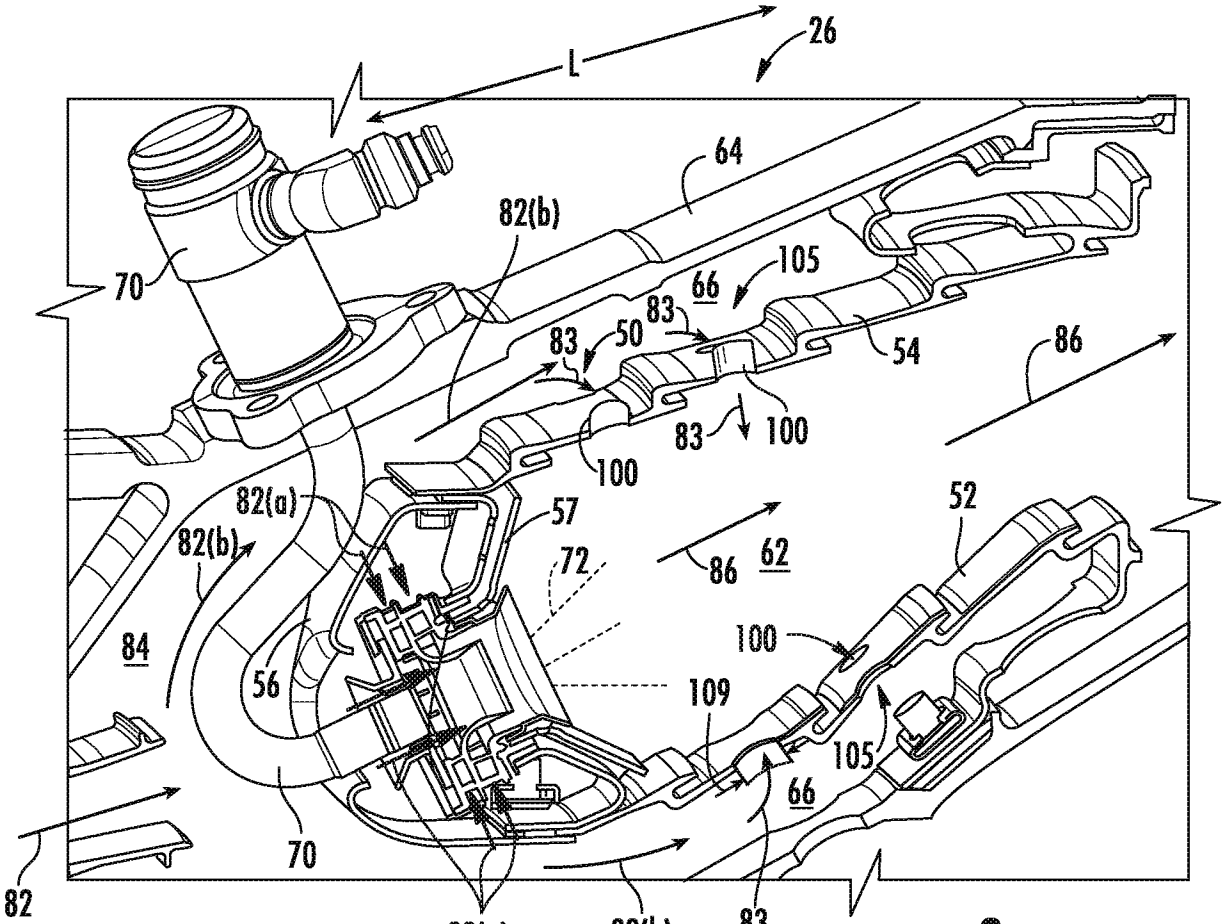
FIG. 2 is a perspective cross sectional view of an exemplary embodiment of a combustor assembly of the exemplary engine shown in FIG. 1.
Figure 3:
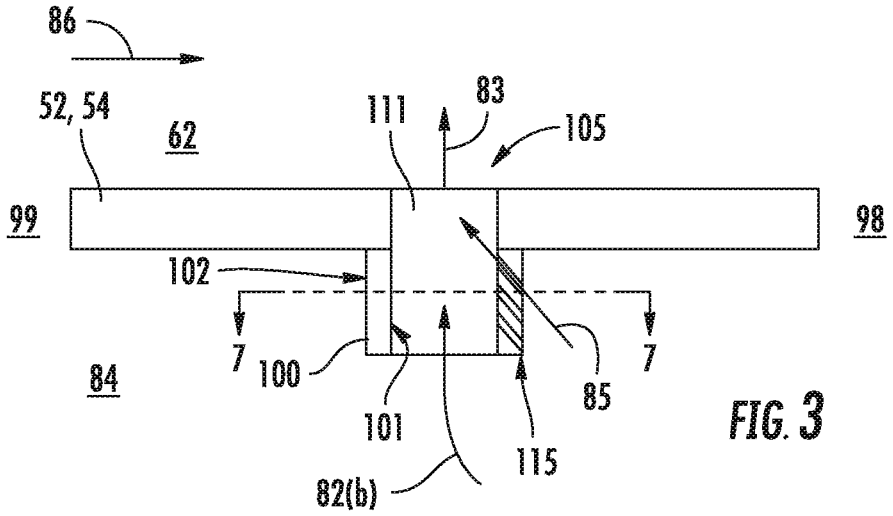
FIG. 3-6 are cross sectional side views of a portion of exemplary embodiments of a walled chute of the combustor assembly of FIG. 2.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a bulkhead 56 that extends radially between upstream ends 58, 60 of the inner liner 52 and the outer liner 54 respectively. In other embodiments of the combustion section 26, the combustion assembly 50 may be a can-annular type. The combustor 50 further includes a dome assembly 57 extended radially between the inner liner 52 and the outer liner 54 downstream of the bulkhead 56. As shown in FIG. 2, the inner liner 52 is radially spaced from the outer liner 54 with respect to engine centerline 12 (FIG. 1) and defines a generally annular combustion chamber 62 therebetween. In particular embodiments, the inner liner 52, the outer liner 54, and/or the dome assembly 57 may be at least partially or entirely formed from metal alloys or ceramic matrix composite (CMC) materials.

As shown in FIG. 2, the inner liner 52 and the outer liner 54 may be encased within an outer casing 64. A surrounding inner/outer flow passage 66 of a diffuser cavity or pressure plenum 84 may be defined around the inner liner 52 and/or the outer liner 54. The inner liner 52 and the outer liner 54 may extend from the bulkhead 56 towards a turbine nozzle or inlet 68 to the HP turbine 28 (FIG. 1), thus at least partially defining a hot gas path between the combustor assembly 50 and the HP turbine 28. A fuel nozzle 70 may extend at least partially through the bulkhead 56 to provide a fuel 72 to mix with the air 82(*a*) and burn at the combustion chamber 62. In various embodiments, the bulkhead 56 includes a fuel-air mixing structure attached thereto (e.g., a swirler assembly).

Referring still to FIG. 2, the inner liner 52 and the outer liner 54 each define one or more openings 105 through the liners 52, 54. A walled chute 100 is disposed at least partially within the opening 105. In various embodiments, the walled chute 100 is extended at least partially into the combustion chamber 62. In other embodiments, the walled chute 100 is extended at least partially into the pressure plenum 84. In still other embodiments, the walled chute 100 is approximately flush or even to the liner 52, 54 to which the walled chute 100 is attached and disposed in the opening 105. The walled chute 100 generally defines a walled enclosure defining a first flow passage 111 (FIGS. 3-6) therethrough from the pressure plenum 84 to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows into a diffuser cavity or pressure plenum 84 of the combustion section 26. The pressure plenum 84 generally surrounds the inner liner 52 and the outer liner 54, and generally upstream of the combustion chamber 62.

The compressed air 82 pressurizes the pressure plenum 84. A first portion of the of the compressed air 82, as indicated schematically by arrows 82(*a*) flows from the pressure plenum 84 into the combustion chamber 62 where it is mixed with the fuel 72 and burned, thus generating combustion gases, as indicated schematically by arrows 86, within the combustor 50. Typically, the LP and HP compressors 22, 24 provide more compressed air to the pressure plenum 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the inner/outer flow passage 66 to provide cooling to the inner and outer liners 52, 54.

Additionally, at least a portion of compressed air 82(*b*) flows out of the pressure plenum 84 into the combustion chamber 62 via the first flow passage 111 (FIGS. 3-6) defined by the walled chute 100, such as depicted via arrows 83. A portion of the compressed air 82(*b*), shown as air 83, egresses from the pressure plenum 84 through the first flow passage 111 (FIGS. 3-6) into the combustion chamber 62. Another portion of the air 82(*b*), depicted via arrows 109 (FIG. 2) may flow through the wall of the walled chute 100. For example, the flow 109 may egress to the combustion chamber 62 via a plurality of flow openings 115 through the walled chute 100, such as further shown and described via arrows 85 in regard to FIGS. 3-8.

Referring now to FIGS. 3-6, the walled chute 100 defines an inner surface 101 at the first flow passage 111. The walled chute 100 further defines a plurality of flow openings 115 through the walled chute 100. In various embodiments, the plurality of flow openings 115 is in fluid communication with the pressure plenum 84.

The walled chute 100 defines an upstream portion 114 and a downstream portion 115 each relative to the flow of combustion gases 86 in the combustion chamber 62. In various embodiments, the plurality of flow openings 115 may be defined anywhere through the walled chute 100. In one embodiment, such as generally depicted in FIGS. 3-7, the plurality of flow openings 115 is defined through the downstream portion 116 of the walled chute 100. More specifically, in regard to the cutaway cross sectional view generally provided in FIG. 7, the walled chute 100 may generally define a circular cross section. The plurality of flow openings 115 may be defined through the downstream portion 116 or half of the walled chute 100 facing the downstream end 98 of the engine 10.

Figure 4:
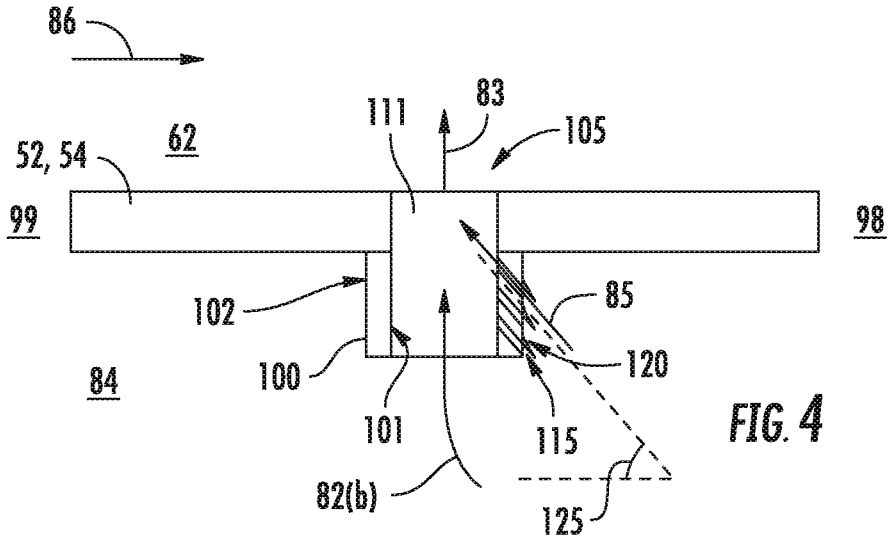

Referring now to FIG. 4, in various embodiments, the walled chute 100 further includes a flow guide member 120 extended from each of the plurality of flow openings 115 through the walled chute 100. In one embodiment, such as generally depicted in regard to FIG. 4, the flow guide member 120 is extended into the pressure plenum 84. The flow guide member 120 may generally define at least partially a tubular structure or walled conduit extended through the walled chute 100 to direct or guide the flow 85 through the walled chute 100. However, in various embodiments, the flow guide member 120 may generally define any geometry to promote or enable the flow 85 through the walled chute 100 from the first flow path 111 to the combustion chamber 62.

Referring still to FIG. 4, in various embodiments, the flow guide member 120 may be extended at an angle 125 relative to walled chute 100. Exemplary angles 125 at which the flow guide member 115 is extended are between 35 degrees and 90 degrees relative to the walled chute 100. For example, the flow guide member 115 may extend substantially perpendicular to the walled chute 100 (e.g., 90 degrees). As another example, the flow guide member 115 may extend into the combustion chamber 62 away from the liner 52, 54 to which the walled chute 100 is attached (e.g., 35 degrees).

Figure 5:
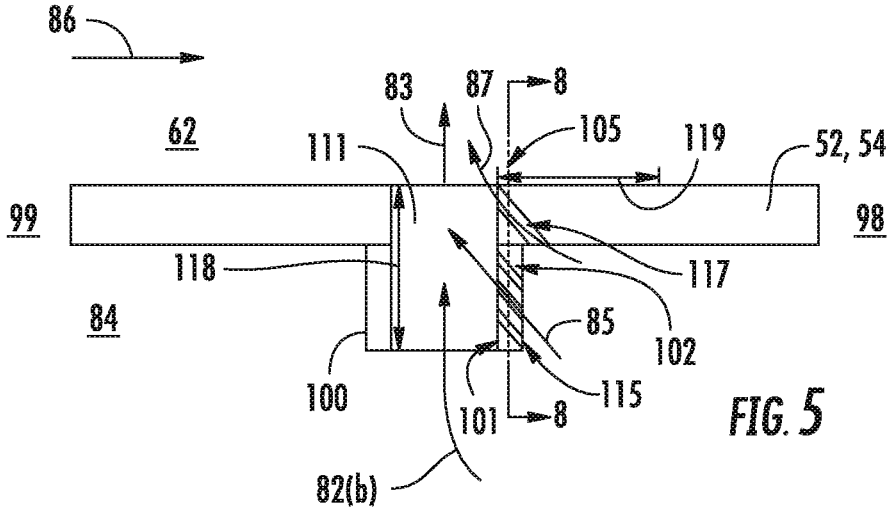

Referring now to FIG. 5, in various embodiments, the liner 52, 54 may define a liner flow opening 117 through the liner 52, 54 in fluid communication with the from the pressure plenum 84 to the combustion chamber 62. The liner flow opening 117 permits a flow of air 87 from the pressure plenum 84 to the combustion chamber 62 such as to mitigate separation of flow 85 from the walled chute 100 through the flow openings 115. In one embodiment, the liner flow opening 117 is defined through the liner 52, 54 within a distance 119 from the walled chute 100 equal to a length 118 of the walled chute 100. For example, the distance 119 from the walled chute 100 within which the liner flow opening 117 is defined through the liner 52, 54 may be defined from the inner surface 101 of the walled chute 100. As another example, the length 118 of the walled chute 100 may be defined through the first flow path 111. As yet another example, the length 118 of the walled chute 100 may correspond to the radial distance from the side of the liner 52, 54 at the pressure plenum 84 to the end of the walled chute 100 in the combustion chamber 62.

Figure 6:
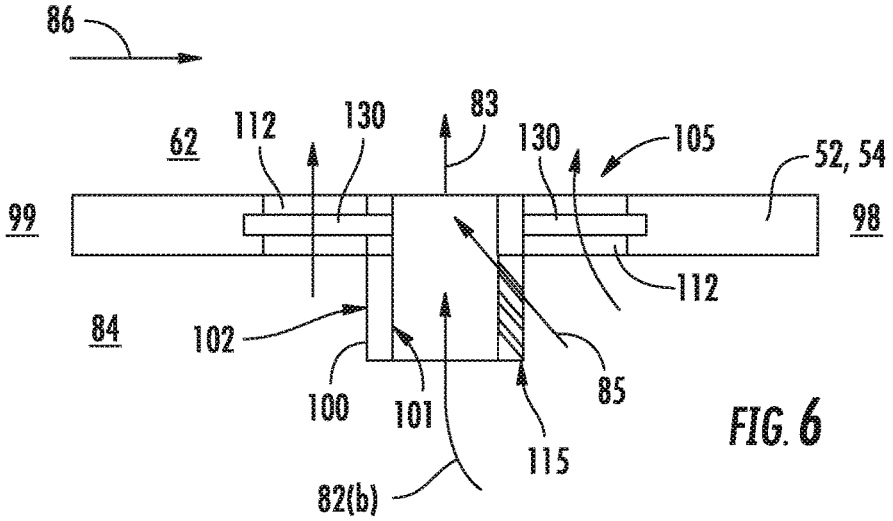
Figure 7:
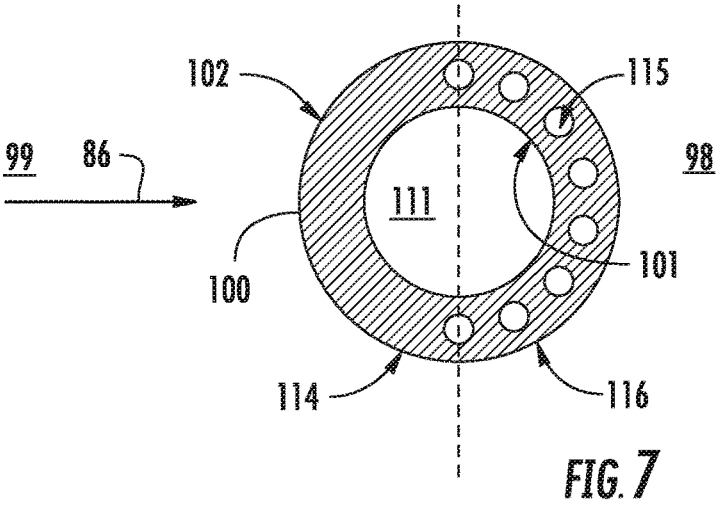
FIG. 7 is a cross sectional view of a portion of an exemplary embodiment of the walled chute of FIGS. 3-6.

Referring now to FIG. 6, in still various embodiments, the combustor assembly 50 further includes a support member 130 extended through the opening 105 from the liner 52, 54 to the walled chute 100. The support member 130 fixes the walled chute 100 within the opening 105 of the liner 52, 54. In one embodiment, the support member 130 and walled chute 100 together define the first flow passage 111 through the walled chute 100 and a second flow passage 112 between the walled chute 100 and the liner 52, 54. As such, the flow of air 83 may be split into two or more pairs, such as depicted via arrows 83 and 83(*a*).

Referring still to FIG. 6, the walled chute 100 supported within the opening 105 by the support member 130 may generally define the first flow path 111 through the walled chute 100 in fluid communication with the combustion chamber 62. However, in other embodiments, the walled chute 100 may be enclosed such as to direct substantially the entire flow 83 through the second flow passage 112.

In one embodiment, the plurality of flow openings 115 is defined through the walled chute 100 tangentially to the inner surface 101 of the walled chute 100. For example, referring to the exemplary embodiment depicted in regard to FIG. 8, the plurality of flow openings 115 may extend through the walled chute 100 from the inner surface 101 to an outer surface 102 such as to define a tangentially extended passage 103 between the inner surface 101 and the outer surface 102.

Figure 8:
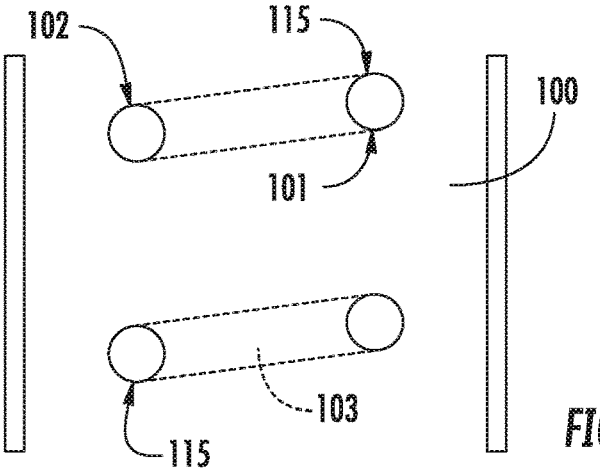
FIG. 8 is a cross sectional view of a portion of the walled chute of FIGS. 3-6.

Referring still to FIG. 8, in another embodiment, the plurality of flow openings 115 may be defined through the walled chute 100 at least partially along the radial direction R relative to the walled chute 100. For example, the plurality of flow openings 115 may extend through the walled chute 100 from the inner surface 101 to the outer surface 102 such as to at least partially define a radially extended passage 103 between the inner surface 101 and the outer surface 102.

It should be appreciated that in various embodiments the passage 103 may extend in both the tangential direction and the radial direction through the walled chute 100.

Embodiments of the walled chute 100 including the flow openings 115 may generally enable, promote, or increase turbulence in the flow of air 83, 85 from the pressure plenum 84 to the combustion chamber 62. The increased turbulence of the flow of air 83 may improve mixing of the flow of air 83, 85 with the combustion gases 86 such as to decrease production of nitrogen oxides (e.g., NOx), improve durability of the combustor assembly 50 (e.g., improve durability at the liners 52, 54), or both. As another example, the walled chute 100 including the plurality of flow openings 115 may further improve mixing of the flow of air 83 with the combustion gases 86 while mitigating losses in penetration of the flow of air 83 with the combustion gases 86 into the combustion chamber 62.

The walled chute 100 further including the support member 130 may further define the support member 130 as a destabilizer member splitting the flow of air 83 into a counter-rotating vortex pair (CVP) into two or more pairs, thereby adding additional vorticity or wake from the flow of air 83 to the jet flow of combustion gases 86. The additional vorticity may induce cross-wise perturbations that may further be amplified or destabilized to enable oscillation to the flow of air 83 defining a dilution jet to the combustion gases 86. The oscillation of the flow of air 83 may improve penetration and mixing of the flow of air 83 with the combustion gases 86 to reduce production of nitrogen oxides (i.e., NOx).

Various embodiments of the engine 10 and combustor assembly 50 may define a rich burn combustor in which the walled chute 100 may define dilution jets providing additional mixing air (e.g., air 83, 85) with a mixture of combustion gases (e.g., combustion gases 86) to improve or complete the combustion process. The walled chute 100 may further define dilution jets that further enable or augment a combustion recirculation zone within the combustion chamber 62 to stabilize a flame therein. Still further, the walled chute 100 may define dilution jets that may relatively rapidly quench the combustion gases 86 to minimize production of nitrogen oxides. Furthermore, various embodiments of the combustor assembly 50 and walled chute 100 shown and described herein may enable customization of a distribution of combustion gas temperature to improve durability of components at or downstream of the combustor assembly 50 (e.g., the liners 52, 54, the HP turbine 28).

Still further, the walled chute 100 may generally define the support member 130 as a bluff-body device such as to provide a jet destabilizer to modify counter rotating vortex pairs (CVP) formed in jets in cross flow (JIC). For example, the portion of air 83 provided through the second flow passage 112 may define a CVP formed relative to the flow of combustion gases 86 defining a JIC.

All or part of the combustor assembly may be part of a single, unitary component and may be manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or any combination thereof may be utilized to construct the combustor 50, including, but not limited to, the liners 52, 54, the walled chute 100, the flow guide member 120, the support member 130, or combinations thereof. Furthermore, the combustor assembly may constitute one or more individual components that are mechanically joined (e.g. by use of bolts, nuts, rivets, or screws, or welding or brazing processes, or combinations thereof) or are positioned in space to achieve a substantially similar geometric, aerodynamic, or thermodynamic results as if manufactured or assembled as one or more components. Non-limiting examples of suitable materials include high-strength steels, nickel and cobalt-based alloys, and/or metal or ceramic matrix composites, or combinations thereof.

Various embodiments of the walled chute 100 including the support member 130 may define the support member 130 of one or more cross sectional areas, such as, but not limited to, a circular cross section, a rectangular cross section, a ovular or racetrack cross section, an airfoil or teardrop cross section, a polygonal cross section, or an oblong cross section, or another suitable cross section, or combinations thereof.

Additionally, or alternatively, various embodiments of the walled chute 100, the opening 105 through which the walled chute 100 is disposed, the flow openings 115, or combinations thereof, may define one or more cross sectional areas, such as, but not limited to, a circular cross section, a rectangular cross section, a ovular or racetrack cross section, an airfoil or teardrop cross section, a polygonal cross section, or an oblong cross section, or another suitable cross section, or combinations thereof.

Furthermore, additional or alternative embodiments of the walled chute 100 may define the inner surface 101, the outer surface 102, or both as a contoured structure, including, but not limited to, a helical, spiral, screw, or grooved structure. The contoured structure of the inner surface 101, the outer surface 102, or both, may substantially correspond to the tangential and/or radial profile of the flow openings 115 through the walled chute 100. However, it should further be appreciated that the inner surface 101, the outer surface 102, or both, of the walled chute 100 may be configured to promote flow turbulence, jet destabilization, or mixing generally of the flows of air 83, 85 with combustion gases 86.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the combustor assembly comprising:

a liner defining a combustion chamber therewithin and a pressure plenum surrounding the liner, wherein the liner comprises an opening, wherein the liner comprises a walled chute disposed at least partially through the opening, wherein a plurality of flow openings is defined through a portion of the walled chute that extends into the pressure plenum surrounding the liner, wherein the walled chute further comprises a plurality of flow guide members, each of which is disposed in contact with a corresponding one of the plurality of flow openings through the walled chute, and wherein each of the plurality of flow guide members are extended from the walled chute into the pressure plenum surrounding the liner, wherein each of the plurality of flow guide members comprises a tubular portion that has a substantially tubular structure disposed through the corresponding one of the plurality of flow openings through the walled chute.

2. The combustor assembly of claim 1, wherein the walled chute defines a flow passage therethrough from the pressure plenum to the combustion chamber.

3. The combustor assembly of claim 2, wherein the plurality of flow openings through the walled chute is in fluid communication with the pressure plenum and the flow passage defined through the walled chute.

4. The combustor assembly of claim 1, wherein the walled chute defines an upstream-downstream direction relative to a flow of gases in the combustion chamber defined by the liner, wherein the walled chute defines an opening direction in which the opening is opened, and wherein the tubular portion of each of the flow guide members extends at an acute angle relative to walled chute when viewed from a direction perpendicular to both the upstream-downstream direction and the opening direction.

5. The combustor assembly of claim 4, wherein the tubular portion of each of the plurality of flow guide members is extended between 35 degrees and 90 degrees relative to the walled chute.

6. The combustor assembly of claim 1, wherein the liner comprises a liner flow opening through the liner in fluid communication with the combustion chamber and the pressure plenum.

7. The combustor assembly of claim 6, wherein the liner flow opening is defined through the liner within a distance from the walled chute equal to a length of the walled chute.

8. The combustor assembly of claim 1, further comprising:

a support member extended through the opening from the liner to the walled chute, wherein the support member fixes the walled chute within the opening of the liner.

9. The combustor assembly of claim 8, wherein the support member and walled chute together define a first flow passage through the walled chute and a second flow passage between the walled chute and the liner.

10. The combustor assembly of claim 1, wherein the plurality of flow openings are defined through the walled chute tangentially to an inner surface of the walled chute.

11. The combustor assembly of claim 1, wherein the plurality of flow openings are defined through the walled chute at least partially along a radial direction relative to the walled chute.

12. The combustor assembly of claim 1, wherein the walled chute has a downstream half and an upstream half, and wherein none of the plurality of flow openings are disposed entirely on the upstream half.

13. The combustor assembly of claim 1, wherein the walled chute defines an upstream portion and a downstream portion each relative to a flow of gases in the combustion chamber defined by the liner, and wherein the plurality of flow openings are defined through only the downstream portion of the walled chute and not through the upstream portion of the walled chute.

14. A gas turbine engine, the gas turbine engine comprising:

a combustor assembly comprising a liner defining a combustion chamber therewithin and a pressure plenum surrounding the liner, wherein the liner comprises an opening, wherein the liner comprises a walled chute disposed at least partially through the opening, wherein a plurality of flow openings is defined through a portion of the walled chute that extends into the pressure plenum surrounding the liner, wherein the walled chute further comprises a plurality of flow guide members, each of which is in contact with a corresponding one of the plurality of flow openings through the walled chute, and wherein each of the plurality of flow guide members is extended from the walled chute into the pressure plenum surrounding the liner, wherein each of the plurality of flow guide members comprises a tubular portion that has a substantially tubular structure disposed through the corresponding one of the plurality of flow openings through the walled chute.

15. The gas turbine engine of claim 14, wherein the combustor assembly further comprises:

a support member extended through the opening from the liner to the walled chute, wherein the support member fixes the walled chute within the opening of the liner.

16. The gas turbine engine of claim 14, wherein the walled chute defines an upstream portion and a downstream portion each relative to a flow of gases in the combustion chamber defined by the liner, and wherein the plurality of flow openings are defined through only the downstream portion of the walled chute and not through the upstream portion of the walled chute.

17. A combustor assembly for a gas turbine engine, the combustor assembly comprising:

a liner defining a combustion chamber therewithin and a pressure plenum surrounding the liner, wherein the liner comprises an opening, wherein the liner comprises a walled chute disposed at least partially through the opening, wherein a plurality of flow openings is defined through a portion of the walled chute that extends into the pressure plenum surrounding the liner, wherein the walled chute defines an upstream-downstream direction relative to a flow of gases in the combustion chamber defined by the liner, wherein the walled chute defines an opening direction in which the opening is opened, and wherein a portion of each of the plurality of flow openings through the walled chute is disposed at an acute angle relative to the walled chute when viewed from a direction perpendicular to both the upstream-downstream direction and the opening direction, wherein the walled chute further comprises a plurality of flow guide members, each of which is in contact with a corresponding one of the plurality of flow openings through the walled chute, and wherein each of the plurality of flow guide members is extended from the walled chute into the pressure plenum surrounding the liner, wherein each of the plurality of flow guide members comprises a tubular portion that has a substantially tubular structure disposed through the corresponding one of the plurality of flow openings through the walled chute.

* * * * *